US007212610B2

(12) United States Patent
Ishikawa et al.

(10) Patent No.: US 7,212,610 B2
(45) Date of Patent: May 1, 2007

(54) X-RAY TUBE ADJUSTMENT APPARATUS, X-RAY TUBE ADJUSTMENT SYSTEM, AND X-RAY TUBE ADJUSTMENT METHOD

(75) Inventors: Masayoshi Ishikawa, Hamamatsu (JP); Takane Yokoi, Hamamatsu (JP); Tsutomu Nakamura, Hamamatsu (JP); Yutaka Ochiai, Hamamatsu (JP); Kinji Takase, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/510,213

(22) PCT Filed: Apr. 4, 2003

(86) PCT No.: PCT/JP03/04356

§ 371 (c)(1),
(2), (4) Date: Aug. 16, 2005

(87) PCT Pub. No.: WO03/086027

PCT Pub. Date: Oct. 16, 2003

(65) Prior Publication Data

US 2006/0067477 A1 Mar. 30, 2006

(30) Foreign Application Priority Data

Apr. 5, 2002 (JP) ..... 2002-103917

(51) Int. Cl.
*H01J 35/14* (2006.01)

(52) U.S. Cl. ..... 378/138; 378/207

(58) Field of Classification Search ..... 378/137, 378/205, 207, 138

See application file for complete search history.

(56) References Cited

U.S. PATENT DOCUMENTS 4,722,097 A * 1/1988 Haendle ..... 378/98.12

(Continued)

FOREIGN PATENT DOCUMENTS

JP 61-218100 9/1986

(Continued)

OTHER PUBLICATIONS

Rao et al., The Modulation Transfer Functions of the X-ray Focal Spots, 1968, Phys. Med. Biol., vol. 14, No. 14, pp. 93-106.*

(Continued)

*Primary Examiner*—Edward J. Glick
*Assistant Examiner*—John M. Corbett
(74) *Attorney, Agent, or Firm*—Drinker Biddle & Reath LLP

(57) ABSTRACT

An initial image (the image of a slit plate 5 imaged when adjusted to an optimal focal diameter) is stored in a storage section 72 of an X-ray tube adjusting apparatus 7. An acquisition section 74 acquires a test image (the image of the slit plate 5 imaged at the time of adjusting the focal diameter). A presentation section 76 presents the initial image and an image representing the luminance on the initial image (showing a contrast Δa between a slit portion 764*a* and a residual area portion 766*a* in the initial image) and the test image and an image representing the luminance on the test image (showing a contrast Δb between a slit portion 764*b* and a residual area portion 766*b* in the initial image) simultaneously (in a comparable manner).

7 Claims, 6 Drawing Sheets

U.S. PATENT DOCUMENTS

| | | | | |
|---|---|---|---|---|
| 6,233,349 | B1 * | 5/2001 | Gravelle et al. | 382/132 |
| 6,359,961 | B1 * | 3/2002 | Aufrichtig et al. | 378/41 |

FOREIGN PATENT DOCUMENTS

| | | |
|---|---|---|
| JP | 05-259249 | 10/1993 |
| JP | 2927206 | 11/1996 |
| JP | 09-071594 | 1/1997 |
| JP | 11-015520 | 1/1999 |
| JP | 2000-210800 | 8/2000 |
| JP | 2000-245721 | 9/2000 |
| JP | 2001-311701 | 11/2001 |
| JP | 2001-351552 | 12/2001 |
| JP | 2002-008572 | 1/2002 |

OTHER PUBLICATIONS

NEMA, "Measurement of Dimensions and Properties of Focal Spots of Diagnostic X-Ray Tubes", Standards Publication No. XR 5-1992 (R1999), National Electrical Manufacturers Association, copyright.1999, entire document.*

Susumu Kogashiwa, et al., "O.F.F. gata Han'ei Sokuteiki no Seisaku". *Bulletin of Tokyo Metropolitan College of Allied Medical Sciences*, Mar. 10, 1995, No. 8, pp. 97-102.

* cited by examiner

X-RAY TUBE ADJUSTMENT APPARATUS, X-RAY TUBE ADJUSTMENT SYSTEM, AND X-RAY TUBE ADJUSTMENT METHOD

TECHNICAL FIELD

The present invention relates to an X-ray tube adjusting apparatus, an X-ray tube adjusting system and an X-ray tube adjusting method.

BACKGROUND ART

If the focal point when an electron beam in an X-ray tube which is an X-ray generating source hits a target is not restricted to an appropriate level at the time of performing nondestructive inspection using an X-ray inspection apparatus, a penumbra is formed in a an imaging area, blurring the image. Even if the focus lens in the X-ray tube (open tube) is initially adjusted so that the focal point is restricted to an appropriate level, the focal point may become wider as the position of the filament or the target is deviated at the time the filament or the target is replaced. The focal point may also become wider when the tube voltage to be applied to the target of the X-ray tube is changed. As a measure in such a case, conventionally, a customer engineer has adjusted the focus lens in such a way that an image appearing on the monitor of the X-ray inspection apparatus becomes absolutely clear.

DISCLOSURE OF THE INVENTION

However, the conventional X-ray tube adjusting method (focus lens adjusting method) had a problem that it was difficult to optimally adjust the focus lens.

The invention has been made to overcome the problem, and aims at providing an X-ray tube adjusting apparatus, an X-ray tube adjusting system and an X-ray tube adjusting method which facilitate optimal adjustment of the focus lens.

To achieve the object, an X-ray tube adjusting apparatus according to the invention is an X-ray tube adjusting apparatus which remotely adjusts an X-ray tube, comprising: storage means which stores, beforehand, an initial image of a subject to be imaged engraved with a given pattern, the initial image having been imaged by an X-ray inspection apparatus having the X-ray tube with a focal diameter of an electron beam at a target of the X-ray tube adjusted so as to be a predetermined value and an imaging device; acquisition means which acquires a test image of the subject to be imaged that is imaged at a time the X-ray inspection apparatus adjusts the focal diameter via a telecommunications line; and presentation means which presents the initial image stored in the storage means and the test image acquired by the acquisition means in a comparable manner.

According to the X-ray tube adjusting apparatus of the invention, an initial image stored in the storage means (the image of a subject to be imaged, which is imaged in a state where the focal diameter of an electron beam at a target of the X-ray tube is adjusted so as to be a predetermined value) and a test image acquired by the acquisition means via a telecommunications line (the image of the subject to be imaged, which is imaged at the time of adjusting the focal diameter) are presented in a comparable manner by the presentation means. Therefore, it is possible to know how much wider the focal point at the time of adjusting the focal diameter (when the test image is imaged) is as compared with the focal point in the adjusted state from the difference in contrast between pattern portions and their peripheral portions of both images presented by the presentation means, and it is further possible to know the adjustment value of the focus lens to set the focal diameter to the predetermined value. As a result, optimal adjustment of the focus lens becomes easy.

It is preferable that the X-ray tube adjusting apparatus according to the invention should include operation means that manipulates a focus lens, which adjusts a beam diameter of the electron beam in the X-ray tube, via the telecommunications line.

The inclusion of the operation means that manipulates the focus lens via the telecommunications line can remotely operate the focus lens without a customer engineer going to the site of the X-ray tube.

To achieve the object, an X-ray tube adjusting system according to the invention is an X-ray tube adjusting system which remotely adjusts an X-ray tube, comprising: an X-ray inspection apparatus having an X-ray tube and an imaging device; and an X-ray tube adjusting apparatus having storage means which stores, beforehand, an initial image of a subject to be imaged engraved with a given pattern, the initial image having been imaged by the X-ray inspection apparatus with a focal diameter of an electron beam at a target of the X-ray tube adjusted so as to be a predetermined value, acquisition means which acquires a test image of the subject to be imaged that is imaged at a time the X-ray inspection apparatus adjusts the focal diameter via a telecommunications line, and presentation means which presents the initial image stored in the storage means and the test image acquired by the acquisition means in a comparable manner, and characterized in that the X-ray inspection apparatus and the X-ray tube adjusting apparatus are connected together via a telecommunications line.

According to the X-ray tube adjusting system of the invention, an initial image stored in the storage means (the image of a subject to be imaged, which is imaged in a state where the focal diameter of an electron beam at a target of the X-ray tube is adjusted so as to be a predetermined value) and a test image acquired by the acquisition means via a telecommunications line (the image of the subject to be imaged, which is imaged at the time of adjusting the focal diameter) are presented in a comparable manner by the presentation means. Therefore, it is possible to know how much wider the focal point at the time of adjusting the focal diameter (when the test image is imaged) is as compared with the focal point in the adjusted state from the difference in contrast between pattern portions and their peripheral portions of both images presented by the presentation means, and it is further possible to know the adjustment value of the focus lens to set the focal diameter to the predetermined value. As a result, optimal adjustment of the focus lens becomes easy.

To achieve the object, an X-ray tube adjusting method according to the invention is an X-ray tube adjusting method for remotely adjusting an X-ray tube, wherein an initial image of a subject to be imaged engraved with a given pattern is stored in storage means beforehand, the initial image having been imaged by an X-ray inspection apparatus having the X-ray tube with a focal diameter of an electron beam at a target of the X-ray tube adjusted so as to be a predetermined value and an imaging device, and comprising: an acquisition step at which acquisition means acquires a test image of the subject to be imaged that is imaged at a time the X-ray inspection apparatus adjusts the focal diameter; and a presentation step at which presentation means presents the initial image stored in the storage means and the test image acquired by the acquisition means in a comparable manner.

Another aspect of the X-ray tube adjusting method according to the invention is an X-ray tube adjusting method, wherein an initial image of a subject to be imaged engraved with a given pattern is stored in storage means beforehand in association with identification information of the X-ray tube, the initial image having been imaged by an X-ray inspection apparatus having the X-ray tube with a focal diameter of an electron beam at a target of the X-ray tube adjusted so as to be a predetermined value and an imaging device, and comprising: an imaging step at which the X-ray inspection apparatus images a test image of the subject to be imaged at a time parts of the X-ray tube are replaced; and a presentation step at which the initial image associated with the identification information of the X-ray tube is acquired from the storage means and presented in such a manner as to be comparable with the test image.

According to the X-ray tube adjusting method of the invention, an initial image stored in the storage means (the image of a subject to be imaged, which is imaged in a state where the focal diameter of an electron beam at a target of the X-ray tube is adjusted so as to be a predetermined value) and a test image (the image of the subject to be imaged, which is imaged at the time of adjusting the focal diameter) are presented in a comparable manner at the presentation step. Therefore, it is possible to know how much wider the focal point at the time of adjusting the focal diameter (when the test image is imaged) is as compared with the focal point in the adjusted state from the difference in contrast between pattern portions and their peripheral portions of both images presented at the presentation step, and it is further possible to know the adjustment value of the focus lens to set the focal diameter to the predetermined value. As a result, optimal adjustment of the focus lens becomes easy.

It is preferable that the X-ray tube adjusting method should include an operation step at which operation means manipulates a focus lens, which adjusts a beam diameter of the electron beam in said X-ray tube, via the telecommunications line.

The inclusion of the operation step that manipulates the focus lens via the telecommunications line can remotely manipulate the focus lens without a customer engineer going to the site of the X-ray tube.

BEST MODES FOR CARRYING OUT THE INVENTION

Preferred embodiments of an X-ray tube adjusting apparatus, an X-ray tube adjusting system and an X-ray tube adjusting method according to the invention will be described in detail below with reference to the accompanying drawings.

First Embodiment

Figure 1:
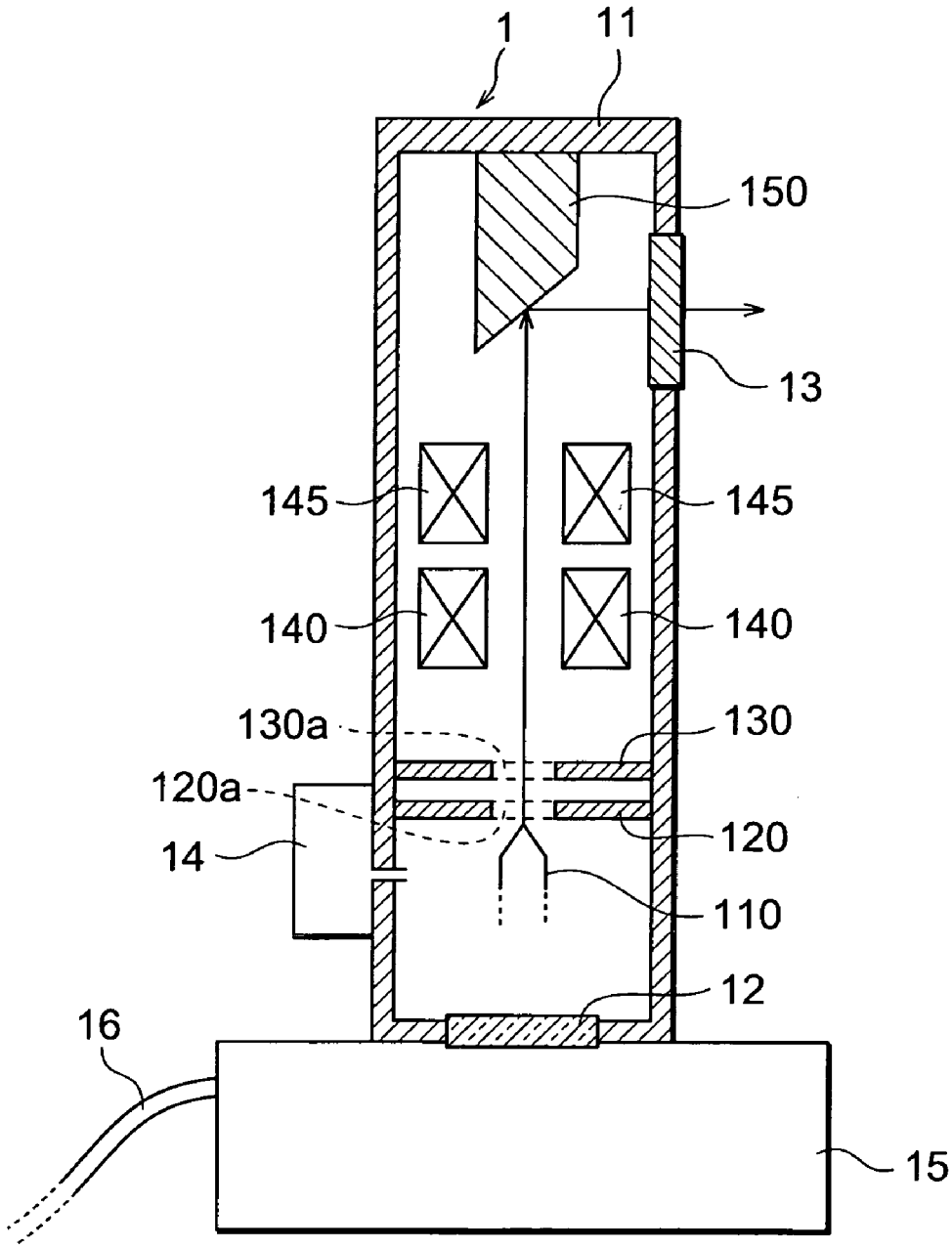
FIG. 1 is an exemplary diagram (cross-sectional view) showing the structure of an X-ray tube 1.

First, the structure and operation of an X-ray tube 1 which is adjusted by an X-ray tube adjusting system according to the embodiment will be described. FIG. 1 is an exemplary diagram (cross-sectional view) showing the structure of the X-ray tube 1. As shown in FIG. 1, the X-ray tube 1 is sealed by the outer casing comprised of a metal enclosure 11, a stem 12 and a beryllium window 13. The X-ray tube 1 has a vacuum pump 14, and a gas inside the outer casing is degassed by the vacuum pump 14 before activation of the X-ray tube 1.

The X-ray tube 1 has, inside of the outer casing, a filament 110 which emits thermions when energized, a first grid electrode 120 which pushes the thermions back toward the filament side and a second grid electrode 130, which pulls the thermions toward the target side, a alignment coil section 140 which adjusts the position of the beam axis of an electron beam, a focus coil section (focus lens) 145, and a tungsten target 150 which generates X-rays when hit by the thermions. The first grid electrode 120, the second grid electrode 130, the alignment coil section 140 and the focus coil section 145 are arranged in that order from the filament 110 toward the target 150, and the first grid electrode 120 and the second grid electrode 130 respectively have an opening 120*a* and an opening 130*a* in their centers for passing the thermions.

The X-ray tube 1 has a power supply 15 including a high-voltage generating circuit for applying a positive high voltage to the target 150.

The X-ray tube 1 is controlled by an X-ray tube controller 2 connected to the X-ray tube 1 by a control cable 16.

When applied with a predetermined voltage and energized, the filament 110 emits thermions. When the voltage which is applied to the first grid electrode 120 rises from the cutoff voltage to an operation voltage, the thermions emitted from the filament 110 are pulled to the second grid electrode 130, which has a higher potential than the filament 110 does, and thus pass through the opening 120*a* of the first grid electrode 120. Further, the thermions pass through the opening 130*a* of the second grid electrode 130 while being accelerated by the tube voltage applied to the target 150, and becomes an electron beam directing toward the target 150 applied with the positive high voltage.

At the time of passing the magnetic field formed in a direction perpendicular to the traveling direction of the electron beam by the alignment coil section 140, the position of the beam axis of the electron beam is adjusted by electromagnetic deflection in such a way as to pass the center of the X-ray tube 1. Further, the beam diameter of the electron beam is contracted by the focus coil section 145. When the electron beam which is converged by the focus coil section 145 hits the target 150, the target 150 generates X-rays. The X-rays pass through the beryllium window 13 and exit the X-ray tube 1. The intensity of the X-rays that are generated by the target 150 is determined by the level of the tube voltage and the magnitude of the tube current. The focal diameter when the electron beam hits the target 150 is changed by the intensity of the magnetic field of the focus coil section 145 (i.e., the magnitude of the current flowing in the focus coil section 145) and the level of the tube voltage.

Figure 2:
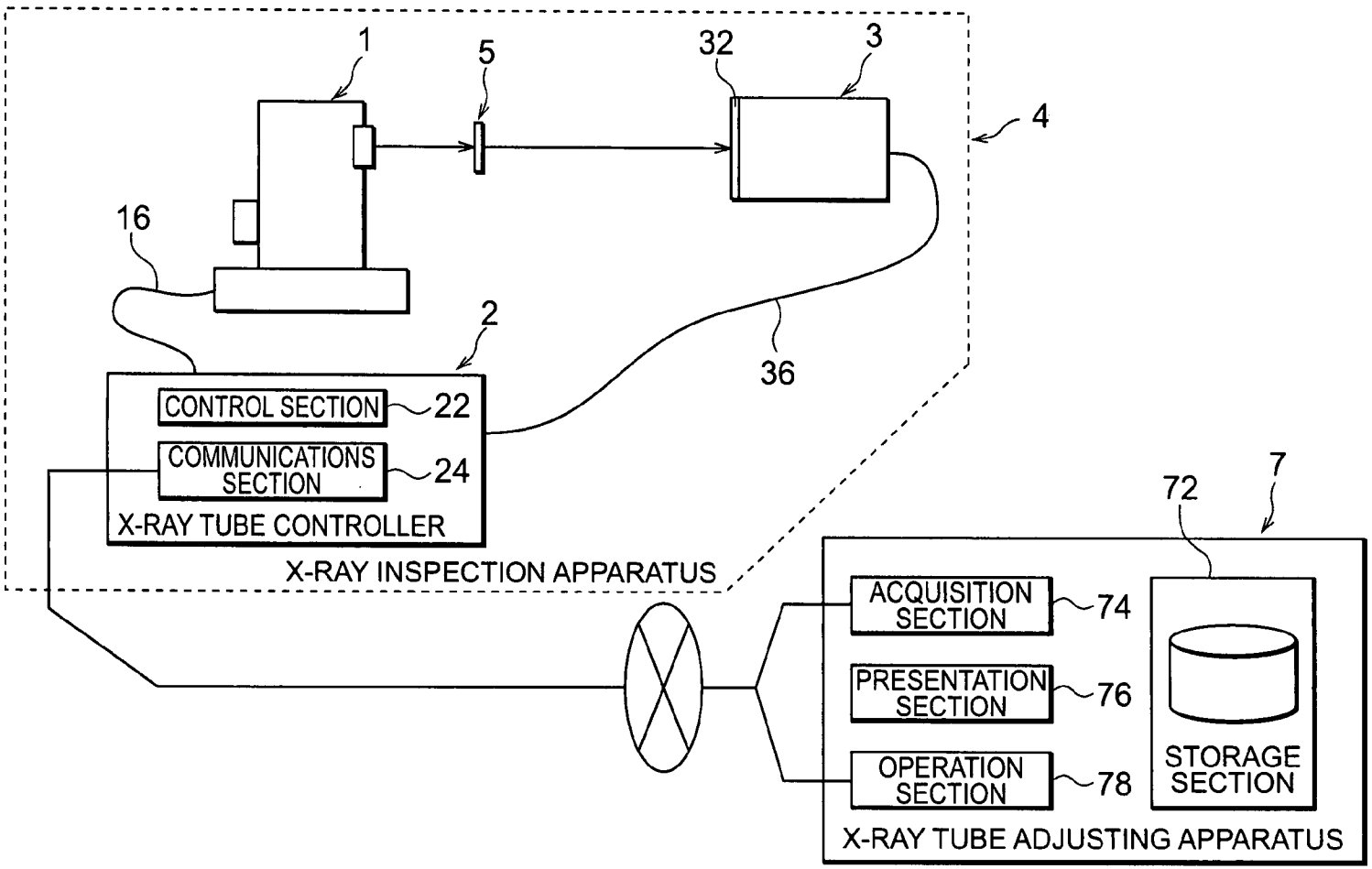
FIG. 2 is a diagram for explaining an X-ray tube adjusting system according to a first embodiment.

Next, the functional structure of the X-ray tube adjusting system according to the embodiment will be described. FIG. 2 is a diagram for explaining the X-ray tube adjusting system according to the first embodiment. As shown in FIG. 2, the X-ray tube adjusting system according to the embodiment has an X-ray inspection apparatus 4 comprising the X-ray tube 1, the X-ray tube controller 2 and an imaging device 3, and an X-ray tube adjusting apparatus 7. The X-ray inspection apparatus 4 is set at the place of a user while the X-ray tube adjusting apparatus 7 is set at the place of a maintenance manager for the X-ray tube, and both are connected via a telecommunications line such as the Internet.

The image imaging device 3 has an imaging area 32, and images an image of a subject to be imaged which appears on the imaging area 32 as X-rays generated by the X-ray tube 1 are irradiated. The image imaging device 3 is connected to the X-ray tube controller 2 by a cable 36.

The X-ray tube controller 2 has a control section 22, and a communications section 24. The control section 22 has a main power supply switch, an X-ray irradiation switch, a tube voltage adjusting section, a tube current adjusting section, etc., and has a function of energizing the filament in the X-ray tube 1, switching of the voltage to be applied to the first grid electrode (cutoff voltage, operation voltage), and controlling adjustment or so of the tube voltage and the tube current. The communications section 24 has a function of sending the image of the subject to be imaged, picked up by the image imaging device 3, to an acquisition section 74 of the X-ray tube adjusting apparatus 7, receiving a control command from an operation section 78 of the X-ray tube adjusting apparatus 7 and transferring it to the control section 22.

Figure 3:
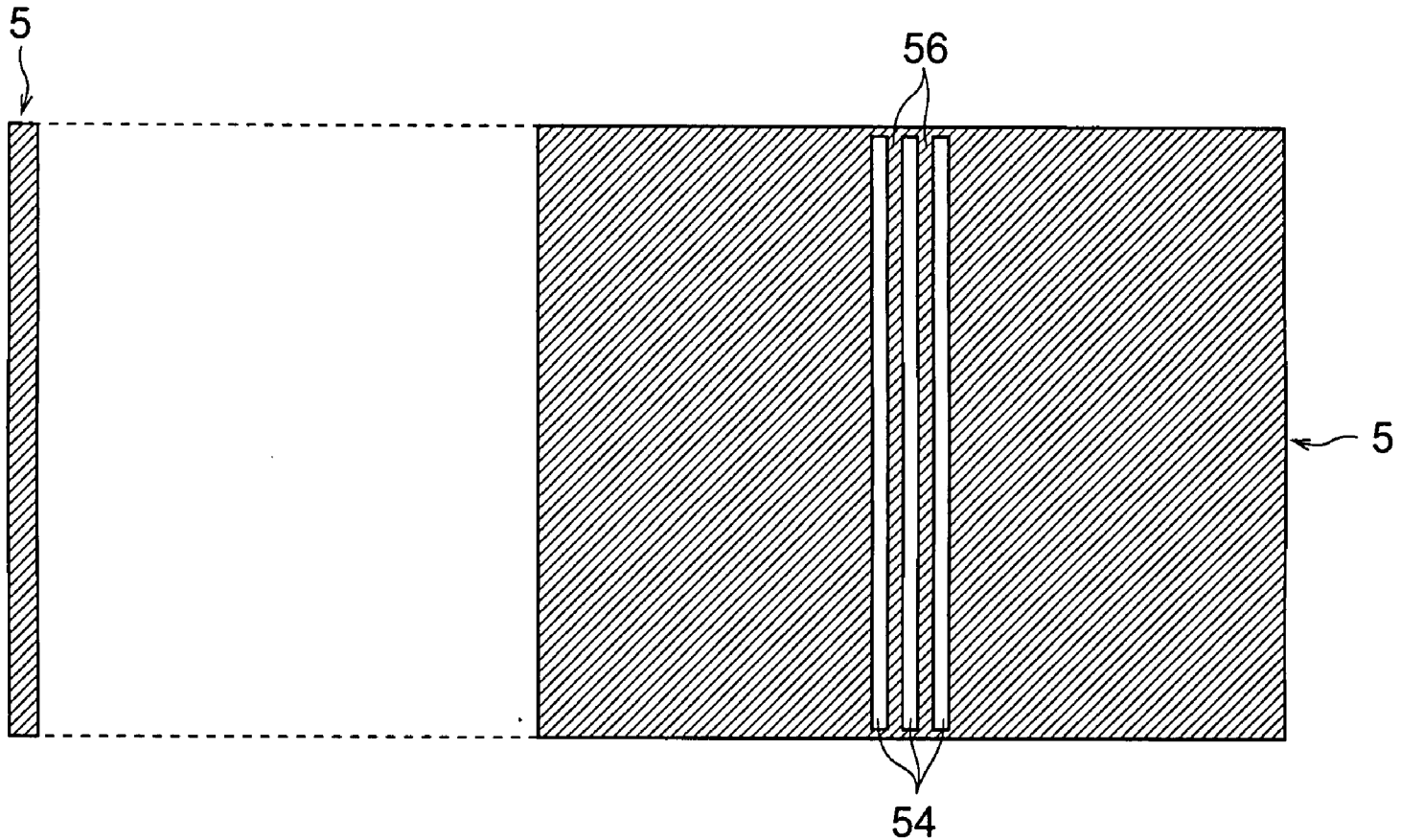
FIG. 3 is a diagram showing the side face and front face of a slit plate 5.

In the embodiment, a slit plate 5 is set as a subject to be imaged in the X-ray inspection apparatus 4. FIG. 3 is a diagram showing the side face and front face of the slit plate 5. The slit plate 5 is made of a material which is difficult for X-rays to pass, and has three slits (pattern) 54 engraved in the center portion, with a residual area 56 formed between the slits 54.

The X-ray tube adjusting apparatus 7 has a storage section 72, the acquisition section 74, a presentation section 76 and an operation section 78. The image (initial image) of the slit plate 5 imaged by the X-ray inspection apparatus 4 having the X-ray tube 1 in a state set at the time of shipment (at the time of shipment, the current value of the focus coil section 145 is set in such a way that the focal diameter becomes the optimal value under the initial tube voltage) as an X-ray source is stored in the storage section 72. The acquisition section 74 has a function of acquiring information, such as the image of the subject to be imaged which is sent by the communications section 24 of the X-ray tube controller 2, and the tube current value of the X-ray tube 1. The presentation section 76 has a function of presenting the initial image and an image representing the luminance on the initial image, and a test image and an image representing the luminance on the test image (details will be given later) simultaneously (in a comparable manner). The operation section 78 has a function of adjusting the current values of the alignment coil section 140 and the focus coil section 145 of the X-ray tube 1 via the telecommunications line.

Figure 5:
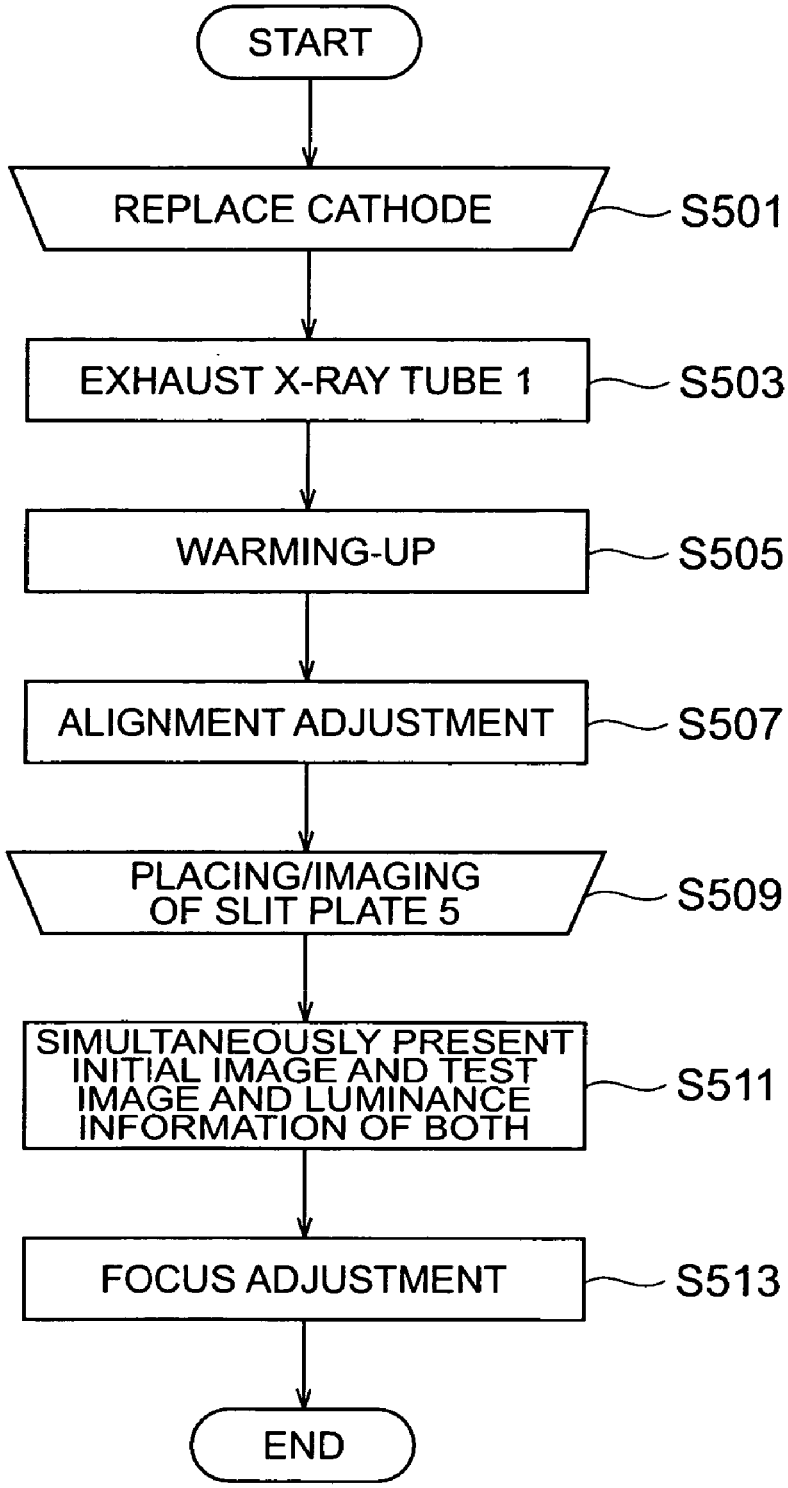
FIG. 5 is a flowchart illustrating procedures from replacement of the filament of an X-ray tube 1 to minimization of the focal diameter.

FIG. 5 is a flowchart illustrating procedures from replacement of the filament of the X-ray tube 1 to minimization of the focal diameter. Referring to FIG. 5, the procedures from replacement of the filament of the X-ray tube 1 to minimization of the focal diameter will be described. First, a user replaces the cathode (S501). When the user uses the X-ray tube 1 for the first time after replacement of the cathode, the user degases the X-ray tube 1 by means of the vacuum pump 14 (S503) and warms up the X-ray tube 1 (S505).

When the filament 110 or the target 150 of the X-ray tube 1 is replaced, the position of the replaced filament 110 or target 150 may be shifted, shifting the beam axis of the electron beam, which reduces the tube current as a consequence. The X-ray tube adjusting apparatus 7 automatically adjusts the position of the beam axis of the electron beam by changing the current value of the alignment coil section 140 in such a way as to maximize the tube current of the X-ray tube 1. A customer engineer checks if the positional alignment of the beam axis of the electron beam has been performed appropriately from the intensity of the X-rays detected by the image imaging device 3 (S507).

As the position of the replaced filament 110 or target 150 may be shifted, the focal point of the electron beam may become wider, so that the focal diameter is minimized by the following process. The user of the X-ray inspection apparatus 4 sets the slit plate 5 at the same position as that where the initial image was imaged, and images it (S509). The image of the slit plate 5 (test image) acquired here is transmitted to the acquisition section 74 of the X-ray tube adjusting apparatus 7 by the communications section 24 of the X-ray tube controller 2.

Figure 4A:
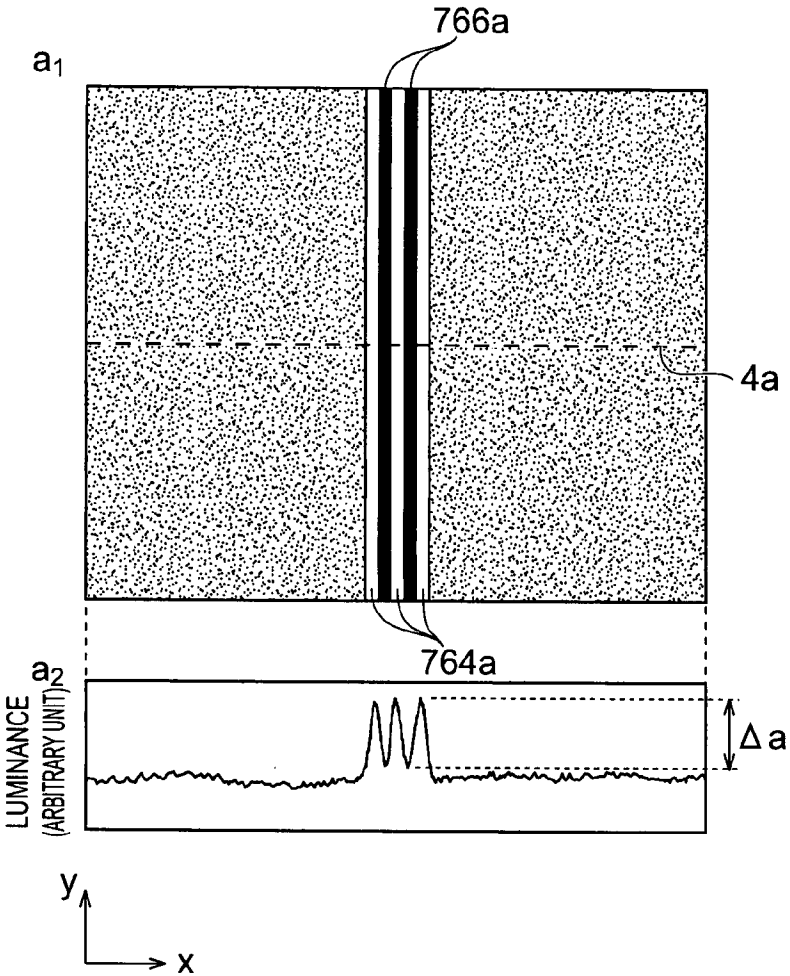
FIG. 4A shows an initial image and an image representing the luminance on the initial image.
Figure 4B:
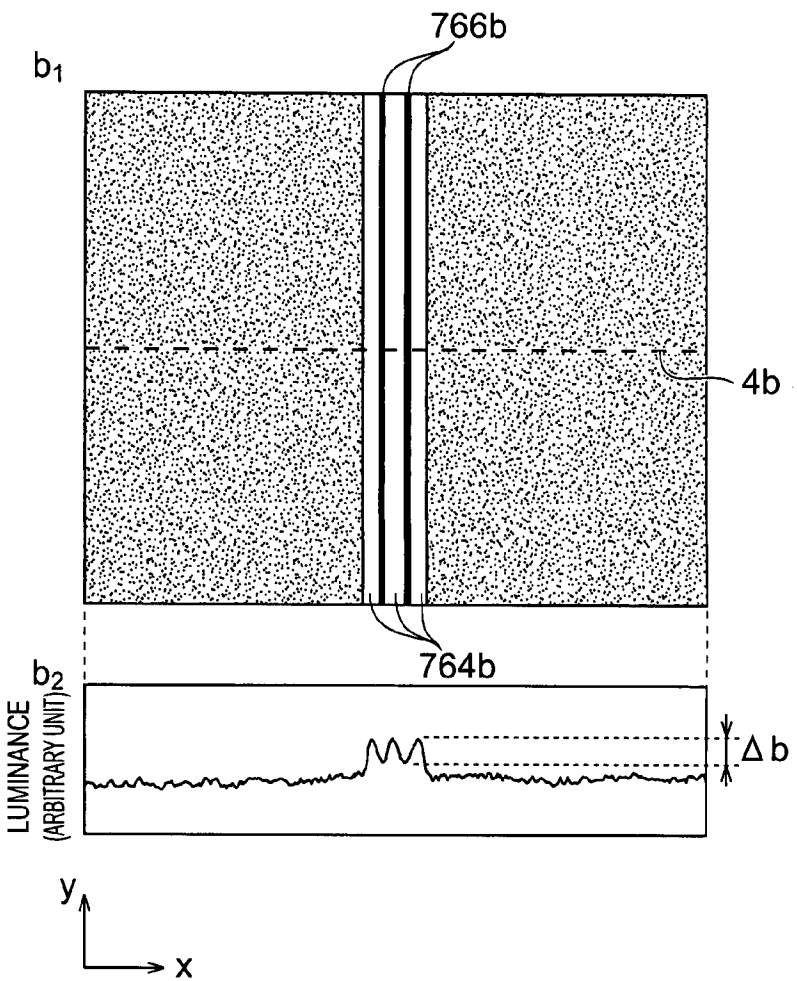
FIG. 4B shows a test image and an image representing the luminance on the test image.

When the acquisition section 74 of the X-ray tube adjusting apparatus 7 acquires the test image, the presentation section 76 presents the initial image stored in the storage section 72 and an image representing the luminance on the initial image, and the test image and an image representing the luminance on the test image simultaneously (in a comparable manner) (S511). FIG. 4A shows the initial image and the image representing the luminance on the initial image presented by the presentation section 76. FIG. 4B shows the test image and the image representing the luminance on the test image. In FIG. 4A, a portion $a_1$ indicates the initial image (the x direction being perpendicular to the lengthwise direction of the slit portion while the y direction is the lengthwise direction of the slit portion), and a portion $a_2$ represents the luminance on a line (line 4*a*) passing the center of the initial image and parallel to the x direction. A slit portion 764*a* equivalent to the slits 54 and a residual area portion (peripheral portion) 766*a* equivalent to the residual area 56 appear in the center portion of the initial image. A high luminance portion corresponding to the slit portion 764*a* and a low luminance portion equivalent to the residual area portion 766*a* appear in the center portion of the portion $a_2$.

In FIG. 4B, a portion $b_1$ indicates the test image and a portion $b_2$ represents the luminance on a line (line 4*b*) passing the center of the test image and parallel to the x direction. While the images that appear at the portion $b_1$ and the portion $b_2$ are similar to images that appear at the portion $a_1$ and the portion $a_2$, the contrast between the slit portion and the residual area becomes lower than the one that appears at the portion $a_1$ and the portion $a_2$. That is, a difference $\Delta b$ between the highest luminance corresponding to the slit portion 764*b* in the portion $b_2$ and a low luminance corresponding to the residual area portion 766*b* becomes smaller than a difference $\Delta a$ between the highest luminance corresponding to the slit portion 764*a* in the portion $a_2$ and a low luminance corresponding to the residual area portion 766*a*. As the focal point of the electron beam in the X-ray tube 1 is restricted to the optimal level at the time the initial image is imaged, the contours of the slit portion 764*a* (bright portion) and the residual area portion 766*a* (dark portion) becomes clear. By way of contrast, the focal point of the electron beam in the X-ray tube 1 is widened at the time the initial image is imaged, a penumbra is produced around the bright portion. Accordingly, the contours of the slit portion 764*b* (bright portion) and the residual area portion 766*b* (dark portion) becomes unclear, so that the luminance at the slit portion 764*b* becomes relatively low and the luminance at the residual area portion 766*b* becomes relatively high.

As the presentation section 76 in the X-ray tube adjusting apparatus 7 presents the initial image and the image representing the luminance on the initial image, and the test image and the image representing the luminance on the test image simultaneously (in a comparable manner), the contrast between the slit portion 764*a* and the residual area portion 766*a* on the initial image can be compared with the contrast between the slit portion 764*b* and the residual area portion 766*b* on the test image, so that it is possible to know from the difference between both contrasts how much the focal point at the time of adjusting the focal diameter (when the test image is imaged) is widened as compared with the focal point at the time of shipment of the X-ray tube 1 (when the current value of the focus coil section 145 is set in such a way that the focal diameter becomes the optimal value under the initial tube voltage). Further, it is possible to compute the current value of the focus coil section 145 to optimize the focal diameter from the comparison of the contrasts, i.e., from the difference between Δa and Δb, thus ensuring auto focus adjustment.

The operation section 78 adjusts the current value of the focus coil section 145 in such a way as to be the current value obtained in the above scheme for setting the focal diameter to the optimal value (S513).

The focal point of the electron beam at the target 150 may also become wide when the tube voltage of the X-ray tube 1 is changed. In this case too, the current value of the focus coil section 145 for adjustment to the optimal focal diameter can be known by comparing the contrast between the slit portion 764*a* and the residual area portion 766*a* on the initial image with the contrast between the slit portion 764*b* and the residual area portion 766*b* on the test image. It is to be noted, however, that as the tube voltage is changed, the intensity of X-rays to be irradiated is changed, so that it is necessary to consider its influence on the contrast between the slit portion 764*b* and the residual area portion 766*b* on the test image.

Next the effect of the X-ray tube adjusting system according to the embodiment will be described. As mentioned above, the presentation section 76 of the X-ray tube adjusting apparatus 7 presents the contrast between the slit portion 764*a* and the residual area portion 766*a* on the initial image and the contrast between the slit portion 764*b* and the residual area portion 766*b* on the test image in a comparable manner, a customer engineer can easily know, from information presented by the presentation section 76, how much the focal point is widened from the focal point restricted to the optimal level, and further know the current value of the focus coil section 145 that should be adjusted to achieve the optimal focal diameter, without going over to the place of the user. Also, the customer engineer can remotely adjust the current value of the focus coil section 145 by using the operation section 78 the X-ray tube adjusting apparatus 7 without going over to the place of the user. As a result, the focus coil section 145 can be adjusted with less labor.

Second Embodiment

Figure 6:
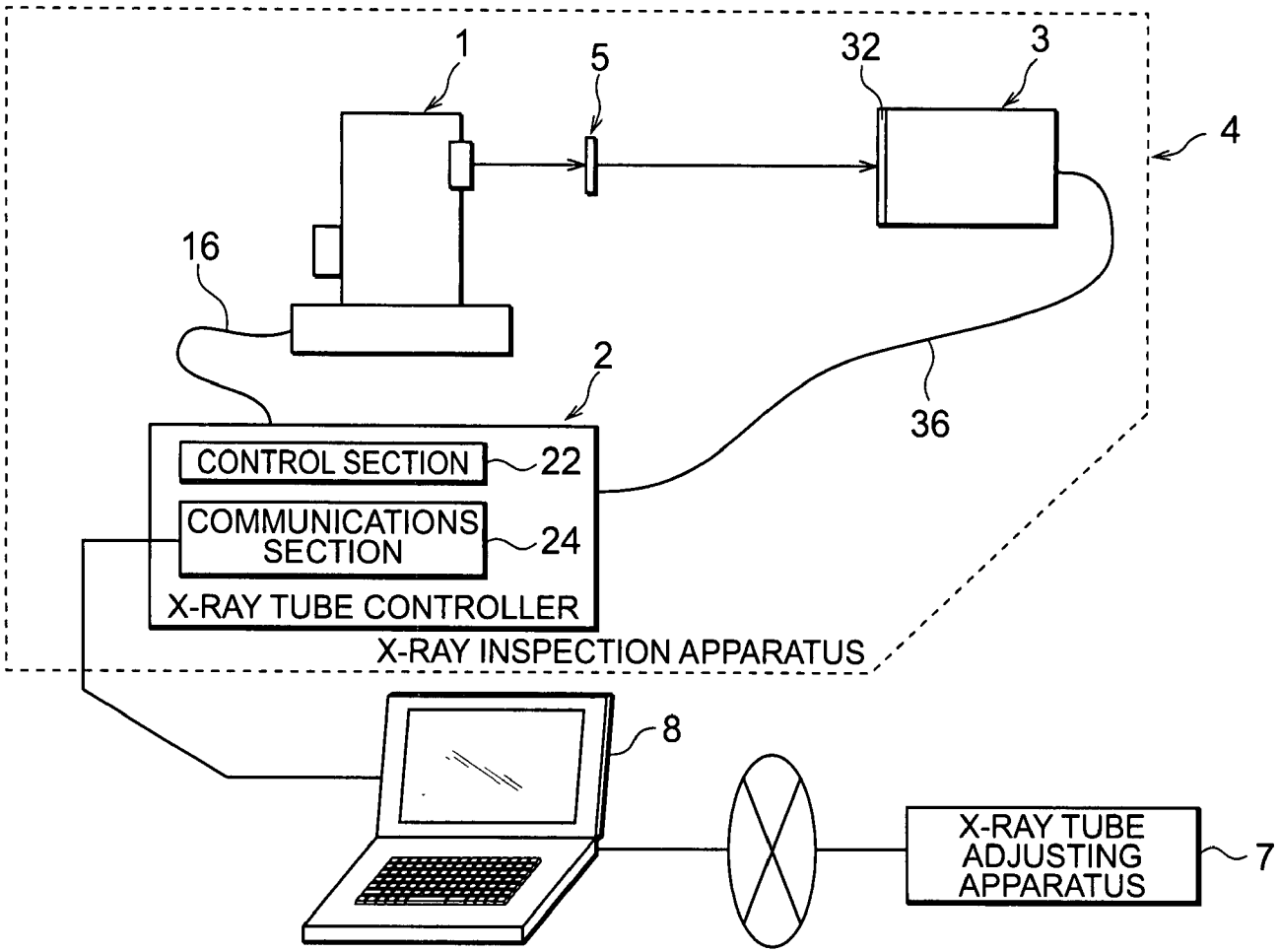
FIG. 6 is a diagram for explaining an X-ray tube adjusting system according to a second embodiment.

FIG. 6 is a diagram for explaining an X-ray tube adjusting system according to the second embodiment. In the second embodiment, a customer engineer goes over to the installation site of the X-ray tube 1 and performs a process from replacement of the filament to focus adjustment. When the maintenance manager receives a user's request of changing the filament, a customer engineer carrying a notebook personal computer 8 goes over to the installation site of the X-ray tube 1. After performing processes similar to the S501 to S507, the customer engineer connects the notebook personal computer 8 to the X-ray tube adjusting apparatus 7, and sends identification information of the X-ray tube 1. The X-ray tube adjusting apparatus 7 acquires the initial image stored in association with the identification information of the X-ray tube 1 from the storage section 72 and downloads it to the notebook personal computer 8. Subsequently, the customer engineer connects the notebook personal computer 8 to the X-ray tube controller 2. The customer engineer shows the initial image and the test image and luminance information of both on the screen of the notebook personal computer 8, and performs processes similar to the S501 to S507.

INDUSTRIAL APPLICABILITY

The X-ray tube adjusting apparatus, the X-ray tube adjusting system and the X-ray tube adjusting method according to the invention can be adapted for adjustment of, for example, medical X-ray generating equipment.

The invention claimed is:

1. An X-ray tube adjusting method, wherein an initial image of a subject to be imaged engraved with a given pattern is stored in storage means beforehand in association with identification information of an X-ray tube, said initial image having been imaged by an X-ray inspection apparatus having said X-ray tube with a focal diameter of an electron beam at a target of said X-ray tube adjusted so as to be a predetermined value and an imaging device, and comprising:

an imaging step at which said X-ray inspection apparatus images a test image of said subject to be imaged at a time parts of said X-ray tube are replaced;

a presentation step at which the initial image associated with the identification information of said X-ray tube is acquired from said storage means and presented in such a manner as to be comparable with said test image; and a focus adjusting step at which referring to images presented at said presentation step, a focus lens of said X-ray tube is adjusted in such a way that a focal diameter of the electron beam at a target of said X-ray tube becomes a desired state.

2. The X-ray tube adjusting method according to claim 1, comprising an operation step at which operation means manipulates a focus lens, which adjusts a beam diameter of the electron beam in said X-ray tube, via a telecommunications line.

3. The X-ray tube adjusting method according to claim 1, further comprising:

an alignment adjusting step at which a position of a beam axis of the electron beam in said X-ray tube is adjusted; and a set step at which, following said alignment adjusting step and prior to said imaging step, said subject to be imaged is placed at a same position as that when said initial image was imaged.

4. The X-ray tube adjusting method according to claim 1, wherein the presentation step involves the presentation of the initial image at the same time as it presents the test image.

5. The X-ray tube adjusting method according to claim 1, wherein the subject to be imaged is a slit plate.

6. The X-ray tube adjusting method according to claim 5, wherein the presentation step involves the presentation of a luminance corresponding to the lines of the slit plate.

7. The X-ray tube adjusting method according to claim 1, wherein the presentation step involves the presentation of a luminance corresponding to the pattern of the subject to be imaged.

* * * * *